US008985719B2

(12) United States Patent
Sasa

(10) Patent No.: US 8,985,719 B2
(45) Date of Patent: Mar. 24, 2015

(54) IMAGE FORMING APPARATUS, IMAGE FORMING APPARATUS CONTROL METHOD AND STORAGE MEDIUM OF PROGRAM OF CONTROL METHOD

(71) Applicant: Tomohiro Sasa, Kanagawa (JP)

(72) Inventor: Tomohiro Sasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/074,175

(22) Filed: Nov. 7, 2013

(65) Prior Publication Data

US 2014/0139573 A1 May 22, 2014

(30) Foreign Application Priority Data

Nov. 20, 2012 (JP) ..... 2012-254265
Oct. 29, 2013 (JP) ..... 2013-224521

(51) Int. Cl.
*B41J 29/38* (2006.01)
*B41J 15/04* (2006.01)

(52) U.S. Cl.
CPC ..... *B41J 15/042* (2013.01)
USPC ..... 347/5

(58) Field of Classification Search
CPC ..... B41J 29/38; B41J 29/393; B41J 11/06; B41J 15/02
USPC ..... 347/5, 16, 101, 104; 399/18
See application file for complete search history.

(56) References Cited

U.S. PATENT DOCUMENTS 8,301,041 B2 * 10/2012 Suzuki ..... 399/9

FOREIGN PATENT DOCUMENTS

| | | |
|---|---|---|
| JP | 6-161613 | 6/1994 |
| JP | 2002-312075 | 10/2002 |
| JP | 2008-225697 | 9/2008 |

* cited by examiner

*Primary Examiner* — An Do
(74) *Attorney, Agent, or Firm* — Oblon, McClelland, Maier & Neustadt, L.L.P.

(57) ABSTRACT

An image forming apparatus using a roll includes a power shutdown operation detector to detect an operation of shutting down power supply to the apparatus; a power supply switching unit to switch power supply condition to the apparatus; and an apparatus controller to control the apparatus. The apparatus controller controls a roll setting operation to set the roll ready for an image outputting operation, and controls the power supply switching unit based on detection of an operation that shuts down the power supply. The apparatus controller confirms whether the power shutdown operation detector detects the power shutdown operation when the roll setting operation is being conducted. When an operation that shuts down the power supply is detected, the apparatus controller aborts the roll setting operation and shuts down power supply to the apparatus.

5 Claims, 8 Drawing Sheets

IMAGE FORMING APPARATUS, IMAGE FORMING APPARATUS CONTROL METHOD AND STORAGE MEDIUM OF PROGRAM OF CONTROL METHOD

CROSS-REFERENCE TO RELATED APPLICATION

This application claims priority pursuant to 35 U.S.C. §119 to Japanese Patent Application Nos. 2012-254265, filed on Nov. 20, 2012 and 2013-224521, filed on Oct. 29, 2013 in the Japan Patent Office, the disclosures of which are incorporated by reference herein in its entirety.

BACKGROUND

1. Technical Field

The present invention relates to an image forming apparatus, a control method and a control program of the image forming apparatus, and more particularly to a power shutdown operation of the image forming apparatus during a roll setting operation.

2. Background Art

With advances in information technology, image processing apparatuses such as printers or facsimile machines for outputting digitized information and scanners for digitizing document information have become indispensible. Such image processing apparatuses have image capturing, image forming, and communications capabilities that enable them to function as printers, facsimile machines, scanners, copiers, or multi-functional apparatuses combining several of these capabilities known as multi-functional peripherals (MFP).

In the image processing apparatuses, various mechanisms are operated to output digitized image data, such as an image forming mechanism to form images, a transport mechanism to transport sheet used as a recording medium of image. To prevent malfunctions, control of the power source of the apparatus is conducted with various settings.

For example, one approach employs a configuration that, when a user conducts a power OFF operation of the apparatus (hereinafter, power-OFF operation) during an image outputting operation, the power is turned off after completing the in-progress image outputting operation to reduce power consumption and enhance usability.

To reduce power consumption and enhance usability, it is preferable that a time period to power off the apparatus after the user conducts the power-OFF operation (hereinafter, power-OFF period) is as short as possible. However, in actual use environment, certain processes may be conducted in the time period before the power source of the apparatus is actually turned off after instructing the power-OFF operation.

For example, in a case of an image forming apparatus using a as cylindrically rolled sheet of paper, etc. as an image recording medium, the roll is feed to the image forming mechanism. In this roll-sheet image forming apparatus, the roll is set for the image outputting operation as follows: When the sheet is set in the apparatus, the sheet is transported to the image forming mechanism that conducts the image outputting operation on the sheet, and then the sheet is set at a position ready for the image outputting operation, with which a roll preparation operation is conducted. The roll preparation operation is also referred to as a roll setting operation.

The roll setting operation includes various processes intended to set the roll at the correct position in the apparatus to conduct the image outputting operation correctly. The roll setting operation requires a given time period to complete once started. Consequently, if the above mentioned power-OFF operation is conducted while the roll setting operation is being conducted the above mentioned power-OFF period may not be short.

SUMMARY

In one aspect of the present invention, an image forming apparatus for outputting an image onto a roll sheet used as recording media is devised. The image forming apparatus includes a power shutdown operation detector to detect that an operation of shutting down power supply to the apparatus is conducted; a power supply switching unit to switch power supply condition to the apparatus; and an apparatus controller to control the apparatus. The apparatus controller includes a roll setting control function to control the roll setting operation so that the roll is transported through the apparatus and readied for the image outputting operation, and a power supply control function to control the power supply switching unit based on a detection of an operation that shuts down the power supply. The apparatus controller confirms whether the power shutdown operation detector detects the power shutdown operation for at least a given number of times when the roll setting operation is being conducted. When an operation that shuts down the power supply is detected by the power shutdown operation detector, the apparatus controller aborts the roll setting operation, and then causes the power supply switching unit to shut down power supply to the apparatus.

In another aspect of the present invention, a method of controlling an image forming apparatus for outputting an image onto a roll sheet a recording media is devised. The method includes the steps of starting a roll setting operation that transports the roll in the apparatus to set the roll ready for an image outputting operation upon receiving an operation instruction from an operation unit; detecting an operation that shuts down power supply to the apparatus is conducted; confirming whether the operation that shuts down power supply to the apparatus is conducted for a given number of times or more when the roll setting operation is being conducted based on the detection result by the detecting step; and aborting the roll setting operation when an operation that shuts down the power supply is detected when the roll setting operation is being conducted; and shutting down power supply to the apparatus.

In another aspect of the present invention, a non-transitory computer-readable storage medium storing a power source control program that, when executed by a computer having a processor, causes the computer to execute a method of controlling an image forming apparatus for outputting an image onto a roll sheet a recording media is devised. The method includes the steps of starting a roll setting operation that transports the roll in the apparatus to set the roll ready for an image outputting operation upon receiving an operation instruction from an operation unit; detecting an operation that shuts down power supply to the apparatus is conducted; confirming whether the operation that shuts down power supply to the apparatus is conducted for a given number of times or more when the roll setting operation is being conducted based on the detection result by the detecting step; and aborting the roll setting operation when an operation that shuts down the power supply is detected when the roll setting operation is being conducted; and shutting down power supply to the apparatus.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
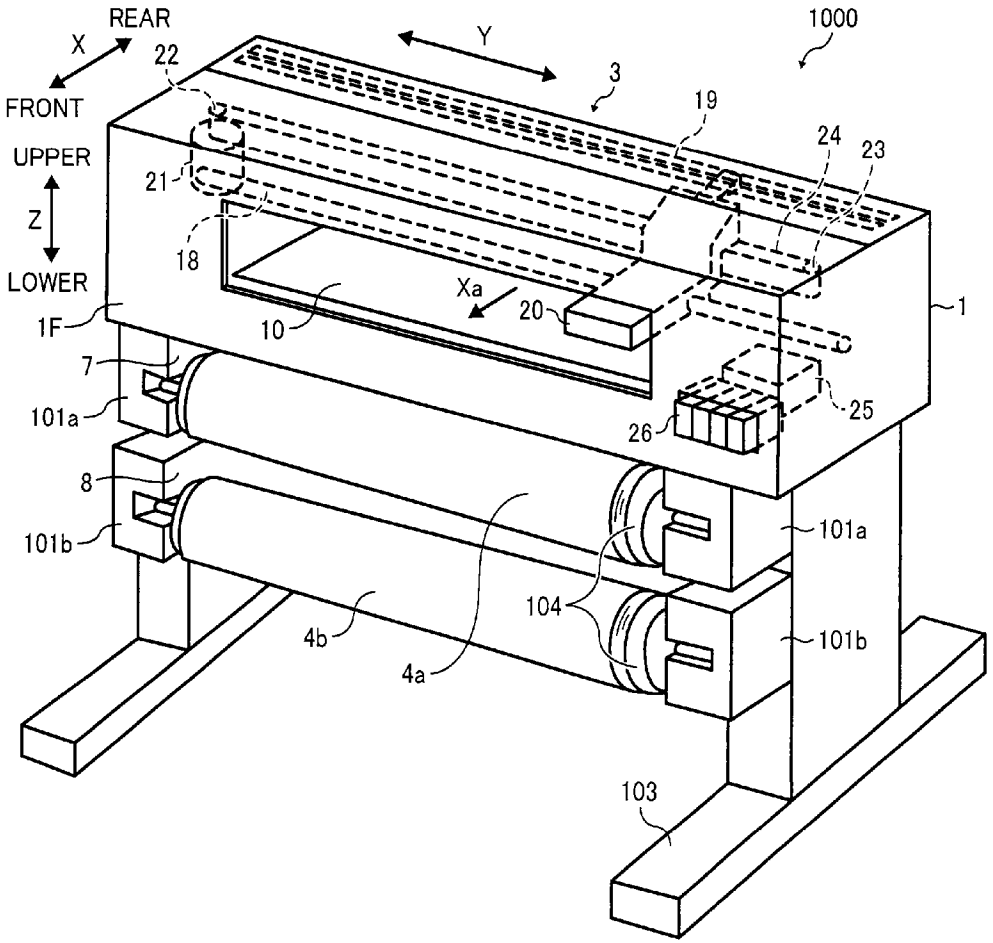
FIG. 1 is a schematic perspective view of an image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner and achieve a similar result. Referring now to the drawings, an apparatus or system according to an example embodiment is described hereinafter.

A description is given of an image forming apparatus using the inkjet method and a roll sheet (hereinafter, may be referred to as roll), and more particularly to a control operation when power shutdown is conducted to the image forming apparatus when the roll setting operation is being conducted. The roll setting operation is conducted to set the roll ready for an image outputting operation in the image forming apparatus.

Figure 2:
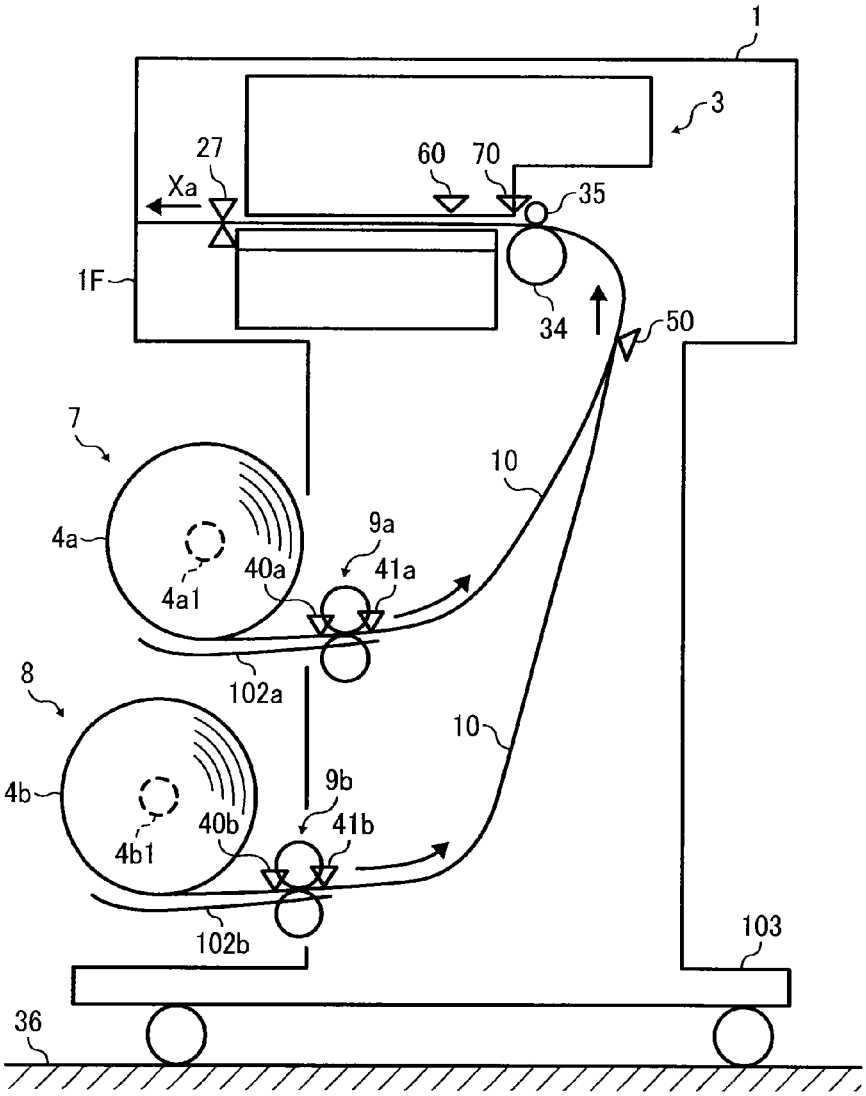
FIG. 2 is a side view of the image forming apparatus of FIG. 1.

FIG. 1 is a schematic perspective view of an image forming apparatus 1000 according to an example embodiment, and FIG. 2 is a side view of the image forming apparatus 1000. Spool axis receivers 101*a* and 101*b* can be used as a roll supporter that can support a roll, which may be prepared by rolling a long length sheet. An upper roll 4*a* and a lower roll 4*b* supported by the spool axis receivers 101*a* and 101*b* can be fed as a sheet 10.

In the front and rear direction X perpendicular to the up and down direction Z, the left side of a body 1 shown in FIG. 1 is used as a front side 1F (front face), and the right side of the body 1 shown in FIG. 1 is used as a rear side (rear face). The main scanning direction Y is perpendicular to the up and down direction Z and the front and rear direction X shown in FIG. 1, and the main scanning direction Y corresponds to the sheet width direction.

An image forming unit 3 is an image forming mechanism employing the inkjet recording method for forming images. As shown in FIG. 2, the image forming apparatus 1000 is, for example, a serial inkjet recording apparatus. A guide rod 18 and a guide rail 19 extend between side plates of the image forming unit 3 of the body 1, and a carriage 20 supported on the guide rod 18 and the guide rail 19 is slide-able in the main scanning direction Y.

The carriage 20 includes a liquid dispensing head such as a liquid recording head for each of black (K), yellow (Y), magenta (M), cyan (C) that dispenses ink droplets of black (K), yellow (Y), magenta (M), cyan (C). Further, the carriage 20 includes a sensor to detect a transported sheet. Each liquid recording head is configured with a sub-tank to supply ink to the liquid recording head.

A main scanning mechanism to move the carriage 20 in the main scanning direction Y includes, for example, a drive motor 21, a drive pulley 22, a driven pulley 23 and a belt 24.

The drive motor 21 is disposed at one side of the main scanning direction Y such as a left side in FIG. 1. The drive pulley 22, linked to an output shaft of the drive motor 21, can be rotated by the drive motor 21. The driven pulley 23 is disposed at other side of the main scanning direction Y such as a right side in FIG. 1. The belt 24 is extended by the drive pulley 22 and the driven pulley 23. The driven pulley 23 is biased toward the outside using a tension spring, which is a direction away from the drive pulley 22.

A part of the belt 24 is fixed to a belt fixing unit disposed on the back of the carriage 20, with which the carriage 20 can be moved in the main scanning direction Y. An encoding sheet is disposed along the main scanning direction Y to detect the main scanning position of the carriage 20 by reading the encoding sheet using an encoding sensor disposed for the carriage 20.

In a main scanning area of the carriage 20, a recording area, which is a transporting area of the sheet, is set. The sheet 10 fed from the upper roll 4*a* or the lower roll 4*b* is transported to the recording area with a transportation unit such as paired-rollers 9*a* and 9*b*, a registration roller 34 and a registration pressure roller 35.

In the recording area, which is an area facing the image forming unit 3, the sheet 10 is transported intermittently into the sub-scanning direction perpendicular to the main scanning direction Y, which is the moving direction of the carriage 20. Specifically, the sheet 10 is transported into a forward direction Xa in the front and rear direction X shown in FIG. 1.

Further, a maintenance unit 25 is disposed at one end of the main scanning area such as the right end side as shown in FIG. 1. The maintenance unit 25 can be used to maintain or recover each liquid recording head in the carriage 20. Further, a main cartridge 26 is detachably attached to the body 1, wherein the main cartridge 26 stores various inks to be supplied to sub-tanks in the liquid recording head.

Further, at a position in the transport route of the sheet 10, which is an exit side of the recording area of the image forming unit 3, a cutter 27 is disposed to cut the sheet having recorded an image in the image forming unit 3 with a given length, wherein the cutter 27 is used as a sheet cutter. The cutter 27 is fixed to a wire and a timing belt entrained around a plurality of pulleys. Further, one of the plurality of pulleys is linked to the drive motor. By moving the wire and the timing belt in the main scanning direction Y via the pulley driven by the drive motor, the sheet can be cut for the given length.

Figure 3:
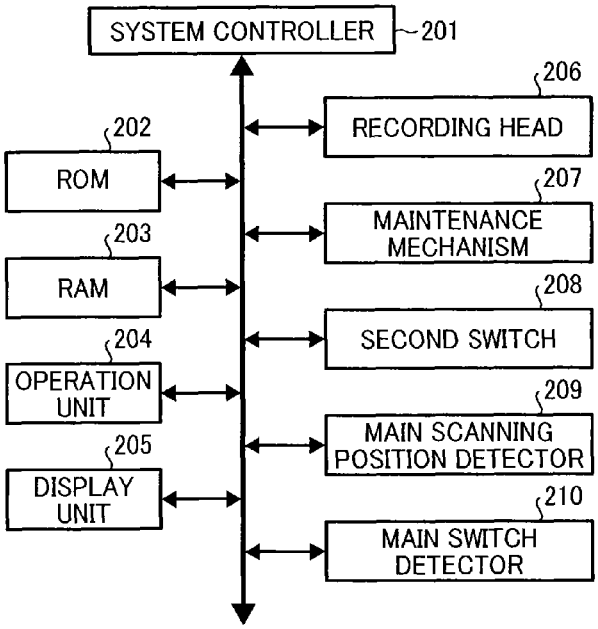
FIG. 3 is a block diagram of a control configuration of the image forming apparatus of FIG. 1.

A description is given of a control configuration of the image forming apparatus 1000 with reference to FIG. 3. FIG. 3 is a block diagram of the control configuration of the image forming apparatus 1000. As shown in FIG. 3, the control configuration of the image forming apparatus 1000 includes, for example, a system controller 201, a read only memory (ROM) 202, a random access memory (RAM) 203, an operation unit 204, a display unit 205, a recording head 206, a maintenance mechanism 207, a second switch 208, a main scanning position detector 209 and a main switch detector 210.

The system controller 201, which can be used as an apparatus controller, controls each device to operate the image forming apparatus 1000. The system controller 201 includes a computing unit such as a central processing unit (CPU) that conducts computing by executing programs to operate the image forming apparatus 1000. Further, the system controller 201 may be configured with a single CPU, or a plurality of CPUs, or a combination with an application specific integrated circuit (ASIC) and a filed programmable gate array (FPGA). The ROM 202, which is a non-volatile storage medium, stores the above mentioned programs for operating the image forming apparatus 1000.

The RAM 203, which is a volatile storage medium, to which high speed reading and writing of information can be conducted. The RAM 203 stores various information required for operating the image forming apparatus 1000, and settings how to control a printing operation when a main switch is turned OFF during the printing operation.

The operation unit 204 is configured with various hard buttons or a touch panel. The operation unit 204 is a user interface, with which an operator can operate the image forming apparatus 1000.

The display unit 205 is a user interface that displays operation instruction and operation condition of the image forming apparatus 1000, and messages to an operator.

The recording head 206 conducts the image outputting operation to the sheet. When the image forming apparatus 1000 employs the inkjet method, the recording head 206 dispenses ink to the sheet to form images on the sheet. The recording head 206 is mounted in the carriage 20 shown in FIGS. 1 and 2.

The maintenance mechanism 207 conducts cleaning of the recording head 206 to maintain condition of the recording head 206. The maintenance mechanism 207 corresponds to the maintenance unit 25 shown in FIGS. 1 and 2. The second switch 208 is a relay that conducts switching under the control of the system controller 201. The second switch 208 conducts the opening and closing of current circuit from the commercial power source when the main switch is turned OFF manually. Therefore, the second switch 208 can function as a power supply switching unit. The main scanning position detector 209 detects a position of the recording head 206 in the main scanning direction. The main switch detector 210 detects ON/OFF state of the main switch, which is switchable manually.

Further, other than the configuration shown in FIG. 3, the control configuration of the image forming apparatus 1000 may include a control configuration to obtain detection signals from various sensors in the image forming apparatus 1000, and a control configuration to control a mechanical configuration of the image forming apparatus 1000 such as rollers used for the sheet transportation, a main scanning motor to move the carriage 20 having the recording head 206 in the main scanning direction.

Figure 4:
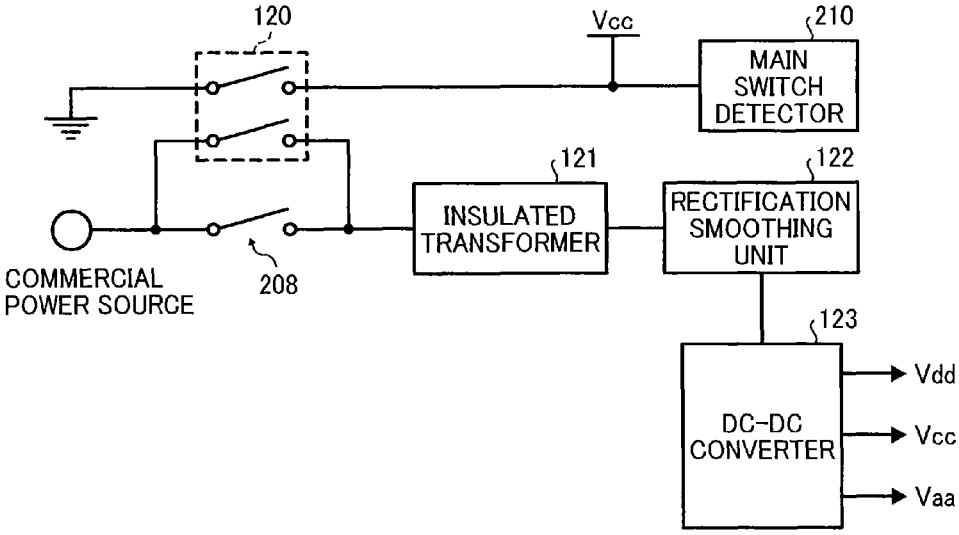
FIG. 4 is a block diagram of a power supply configuration of the image forming apparatus of FIG. 1.

A description is given of a configuration for power supply of the image forming apparatus 1000 with reference to FIG. 4. A main switch 120 shown in FIG. 4 is manually switched by an operator to switch power supply condition to the image forming apparatus 1000. As shown in FIG. 4, the main switch 120 includes, for example, two switches, wherein one switch connected to the earth and one switch connected to the commercial power source.

As shown in FIG. 4, among the two switches, a lower switch is used to turn ON/OFF of power of the commercial power source, and a upper switch is used to transmit the ON/OFF state to the system controller 201.

The upper switch is connected to the main switch detector 210 shown in FIG. 3. The main switch detector 210 detects ON/OFF state of the main switch 120 based on whether the input voltage is system ground or Vdd. Therefore, the main switch detector 210 can function as a power shutdown operation detector.

The lower switch of the main switch 120 is in a primary circuit, and the upper switch of the main switch 120 is in a secondary circuit, and they are insulated with a given distance.

As above described with FIG. 3, the second switch 208 is a relay circuit that switches ON/OFF state under the control of the system controller 201.

Depending on the ON/OFF state of the main switch 120 detected by the main switch detector 210, the second switch 208 conducts the opening and closing of current circuit from the commercial power source. Specifically, the system controller 201 conducts power supply control function to switch the power supply to the apparatus by controlling the second switch 208 used as a power supply switching unit.

A series of control starting from the time that an operator operates the main switch 120 when the power source is ON to the time that the second switch 208 shuts down the power supply from the commercial power source is referred to as a shutdown sequence. The shutdown sequence controlled and conducted by the system controller 201.

The insulated transformer 121 is supplied with power from the commercial power source via the second switch 208, and then conducts voltage transformation of power under the insulated condition, and then supplies the power to the secondary circuit.

A rectification smoothing unit 122 rectifies the alternating-current (AC) power having received the voltage transformation by the insulated transformer 121, to direct-current (DC) power using a diode bridge, and smoothes the direct-current (DC) power using a capacitor. A DC-DC converter 123 generates voltages Vdd, Vcc and Vaa required for each unit in the inkjet recording apparatus using the power from the rectification smoothing unit 122, and supplies the voltages to each unit in the inkjet recording apparatus.

In the above described configuration, the sheet 10 is fed from the upper rolls 4*a* and 4*b*, and is then set in the image forming apparatus 1000 by conducting transportation and positioning, and the sheet 10 is sandwiched by the registration roller 34 and the registration pressure roller 35, with which the sheet 10 is set ready for the image outputting operation or image forming operation. This operation is referred to as a roll setting operation. The power source control when the roll setting operation is conducted is to be described in this specification.

Figure 5:
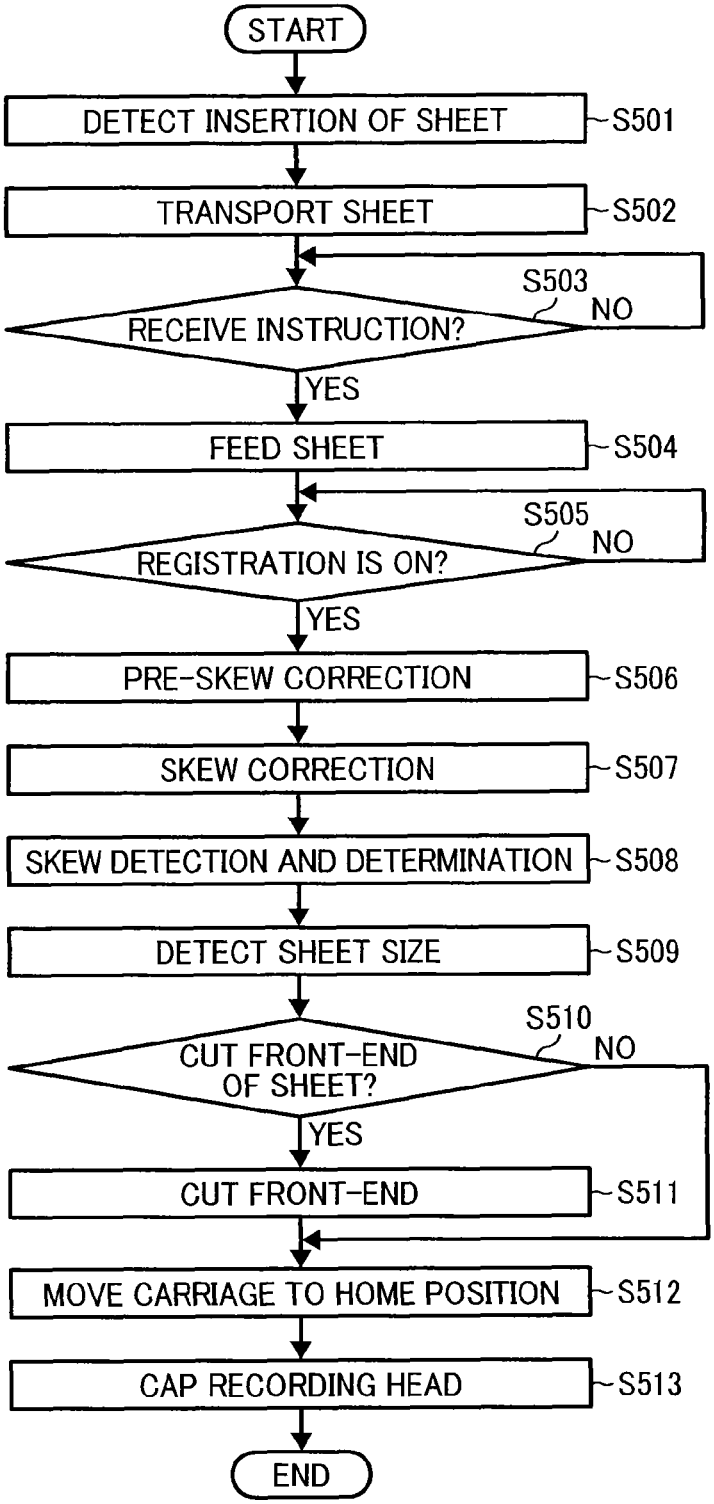
FIG. 5 is a flowchart showing steps of a roll setting operation of the image forming apparatus of FIG. 1.

A description is given of an operation of the image forming apparatus 1000 according to an example embodiment with reference to FIG. 5, which is a flowchart showing steps of the roll setting operation according to an example embodiment.

When a user inserts a front end of the upper roll 4*a* or the lower roll 4*b* into a sheet feed port 102*a* or a sheet feed port 102*b*, a feed port sensor 40*a* or the feed port sensor 40*b* detects the inserted sheet 10 (S501).

When the feed port sensor 40*a* or the feed port sensor 40*b* detects the sheet 10, the system controller 201 controls the paired-roller 9*a* or the paired-roller 9*b* disposed at the sheet feed port, used as the transportation unit, to transport the sheet 10 to the sheet setting position 41*a* or the sheet setting position 41*b* (S502). Specifically, the system controller 201 conducts a roll setting control function to control the roll setting operation.

The user who inserted the front end of roll in the sheet feed ports 102*a* and 102*b* may conduct the sheet setting instruction operation to the operation unit 204 (S503). The sheet setting instruction operation includes a selection instruction of a front-end cut of the roll and a selection instruction of sheet type such as determining whether the sheet type is correct. Upon receiving the operation instruction via the operation unit 204 (S503: YES), the system controller 201 controls each unit in the apparatus to conduct a sheet transport operation (S504).

At S504, the system controller 201 drives the main scanning motor to move the carriage 20 in the main scanning direction to a position that the front end of the sheet 10 can be detected by using a sheet detection sensor 60 disposed for the carriage 20 (hereinafter, sheet-front-end detection position). Further, at S504, the system controller 201 drives the roller disposed along the transport route to start the sheet transportation.

A pre-registration sensor 50 is disposed at the end of the sheet transport route that is used for transporting the sheet in the transport route. Specifically, the pre-registration sensor 50 is disposed at a position right before the image forming unit 3 to detect the front end of sheet (S505: YES). Then, the system controller 201 conducts a pre-skew correction operation (S506).

The pre-skew correction operation at S506 is a preliminary skew correction operation conducted before a skew correction operation (S507) is conducted. If the sheet having a greater skew is transported in the sub-scanning direction and then the skew correction operation is conducted, the sheet may be damaged. To prevent the sheet damage, the pre-skew correction operation is conducted to correct the skew for some amount, with which the sheet damage during the skew correction operation can be prevented. The pre-skew correction operation will be described later in detail.

Upon completing the pre-skew correction operation, the system controller 201 conducts the skew correction operation (S507). At S507, the sheet 10 is transported for 1 mm or so in the forward direction Xa of the sub-scanning direction and then rolled back to conduct the skew correction of the sheet 10. The number of operation times of transportation and rolling back can be set by a designer. If it is determined that skew is detected by the first time skew detection, the sheet is rolled back and then transported again, and then the skew detection is conducted again.

The sheet being transported with an inclined angle with respect to a transport direction is corrected by the skew correction operation. After the skew correction operation, the system controller 201 conducts a skew detection and determination operation to confirm whether the skew correction has completed correctly (S508). If it is determined that the skew correction has not completed correctly at S508, the skew correction is conducted again. Further, if the skew correction has not completed correctly even if the skew correction is repeated for a given number of times, the system controller 201 conducts the sheet ejection by rolling back the sheet.

If it is determined that the skew correction has completed correctly at S508, the system controller 201 conducts a process of detecting the sheet size (S509). Upon completing the sheet size detection, the system controller 201 drives the transport roller to roll back the sheet 10 to a waiting position which is right before the image forming unit 3. With reference to the instruction received at S503, the system controller 201 determines whether cutting of the front end of sheet 10 is required (S510). Further, the waiting position of the sheet 10 is a position that the front end of sheet 10 is detected by a sensor 70 shown in FIG. 2.

If the front-end cutting is instructed (S510: YES), the system controller 201 controls each unit in the apparatus to conduct the front-end cutting (S511). At S511, the system controller 201 drives the transport roller to transport the sheet 10 from the waiting position for a given distance in the forward direction Xa in the sub-scanning direction, and drives the wire and the timing belt for the cutter 27 to cut the front end of sheet 10. Then, the system controller 201 drives the transport roller to roll back the front end of sheet 10 to the above described waiting position.

If the front-end cutting is not instructed (S510: NO) or the front-end cutting is completed, the system controller 201 drives the main scanning motor to move the carriage 20 to a home position (S512). Then, the system controller 201 controls the maintenance unit 25 to cap the recording head 206 mounted in the carriage 20 (S513). With this processing, the roll setting operation completes.

In this roll setting operation, at one or more steps shown in FIG. 5, a determination process whether to conduct power-OFF operation by the main switch detector 210 (hereinafter, shutdown determination process) is included. Specifically, the shutdown determination process is included in the sequence of the pre-skew correction operation at S506, the skew correction operation at S507 and the skew detection and determination operation at S508.

To complete the shutdown of the power supply to the apparatus within a given shorter time elapsed from the time when an operator operated the main switch 120, the shutdown determination process is required to be conducted during the roll setting operation at one or more timings. Specifically, the shutdown determination process can be conducted at S506, S507 and S508 as disclosed in this description. If the shutdown is determined during the roll setting operation, the roll setting operation is aborted to conduct the shutdown of the apparatus, with which the shutdown of the power supply to the apparatus can be conducted within a shorter time.

Further, at processes other than S506 to S508 in the process shown in FIG. 5, the sheet transportation such as the sheet transportation from the sheet feed ports 102*a* and 102*b* to the pre-registration sensor 50, and the sheet transportation in an image forming area facing the image forming unit 3 are conducted. If the power OFF state occurs during the sheet transportation, sheet jamming may occur when the power is turned ON again. By conducting the shutdown determination process at S506 to S508, such jamming can be prevented.

In an example embodiment, the apparatus can be turned power OFF state without completing the roll setting operation and without causing the abnormality or malfunction of the apparatus when the power is turned ON again. When the apparatus is turned power OFF state before completing the roll setting operation, the apparatus is preferably returned to a condition before starting the roll setting operation so that the abnormality or malfunction of the apparatus which may be occurred when the power is turned ON again can be prevented. In an example embodiment, the roll setting operation may be canceled at S506 to S508, and upon cancelling the roll setting operation, the sheet ejection operation is conducted. The shutdown operation can be conducted in related with the above described roll setting operation and cancelling operation, with which change of program to control the apparatus according to an example embodiment can be reduced, which will be described later.

Figure 6:
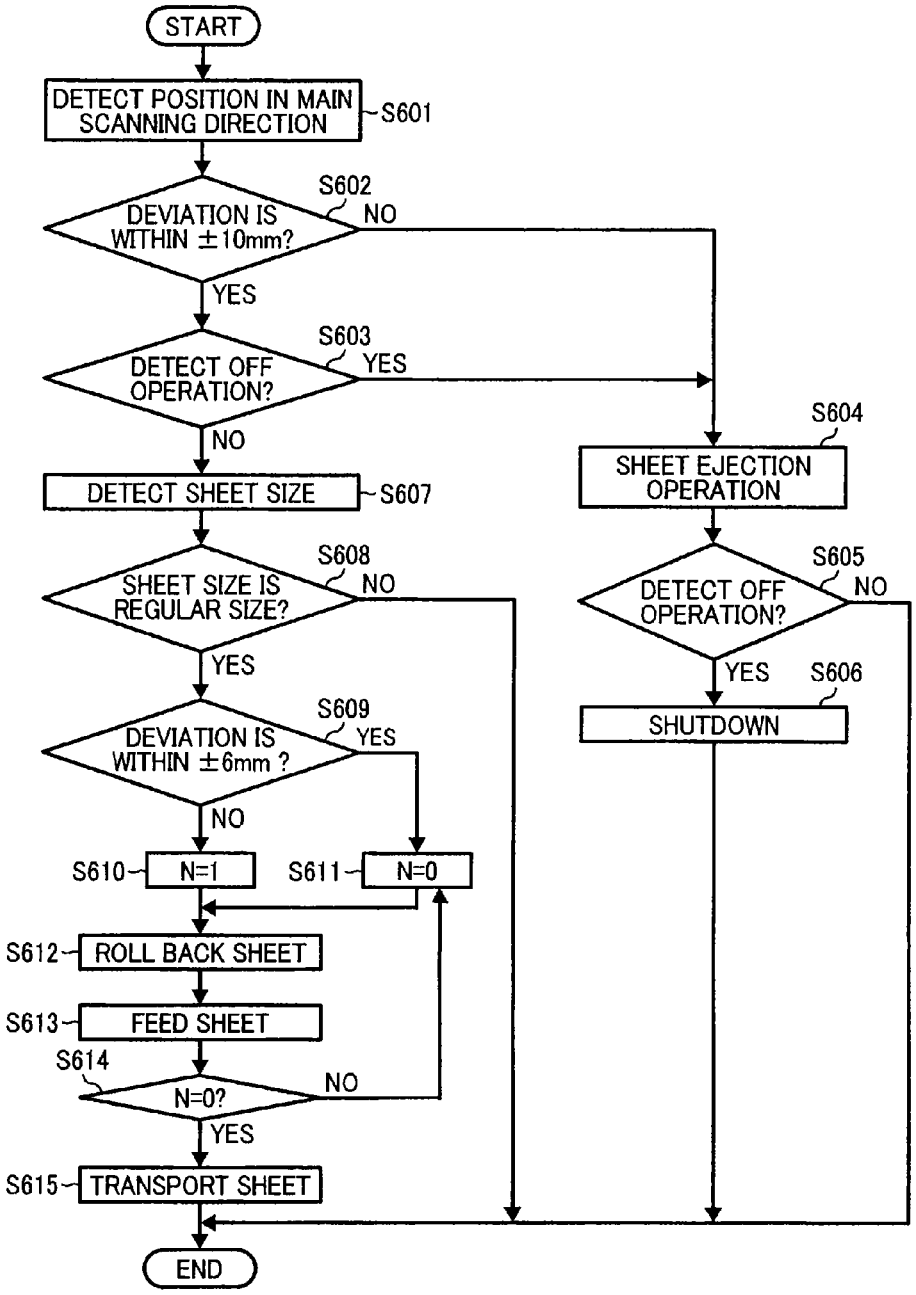
FIG. 6 is a flowchart showing steps of a pre-skew correction operation of the image forming apparatus of FIG. 1.

A description is given of the pre-skew correction operation at S506 with reference to FIG. 6. In the pre-skew correction operation shown in FIG. 6, the system controller 201 detects a position of end of the sheet 10 based on a detection signal of the sheet detection sensor 60 disposed for the carriage 20, which means the system controller 201 detects a position of the sheet 10 in the main scanning direction (S601). Then, the system controller 201 compares the detected sheet end position and a preset reference position (S602).

If a difference between the detected position and the reference position is greater than, for example, ±10 mm (S602: NO), the system controller 201 determines that the skew correction cannot be conducted preferably using a mechanical control, and conducts a sheet ejection operation (S604). At S604, the transport roller disposed along the transport route of the sheet is rotated in a backward direction to roll back the sheet, and the pre-skew correction operation and the roll setting operation are aborted.

If a difference between the detected position and the reference position is within ±10 mm (S602: YES), the system controller 201 confirms whether the main switch detector 210 detects the OFF operation of the main switch 120 (S603). If the OFF operation of the main switch 120 is detected (S603: YES), the system controller 201 conducts the sheet ejection operation (S604).

Upon completing the sheet ejection operation (S604), the system controller 201 confirms whether the OFF operation of the main switch 120 is conducted again (S605). If the OFF operation of the main switch 120 is detected (S605: YES), the system controller 201 controls the second switch 208 to set the apparatus power source at OFF state (S606). By contrast, if the OFF operation of the main switch 120 is not detected (S605: NO), which means when the sheet ejection operation is conducted (S604) because the difference between the detected position and the reference position exceeds ±10 mm (S602: NO), the process ends.

In the shutdown determination process during the pre-skew correction operation, it is determined whether the roll setting operation is continued based on the end position of the sheet. If it is determined that the roll setting operation is not continued, the roll is ejected, and the roll setting operation is aborted in relation with S602 and S603.

In an example embodiment, to prevent the sheet jamming, the apparatus power source is required to be turned OFF state after the apparatus is returned to a condition before the roll setting operation is started. Such control can be conducted using a control of the sheet ejection operation included in the program originally, with which change of program to control the apparatus according to an example embodiment can be reduced.

If the OFF operation of the main switch 120 is not detected at S603 (S603: NO), the system controller 201 continues a normal pre-skew correction operation. In the normal pre-skew correction operation, the system controller 201 detects sheet size based on a detection signal of the sensor disposed for the carriage 20 (S607). Upon detecting the sheet size, the system controller 201 compares the detected sheet size and a regular size (S608). If the detected sheet size is greater than the regular size (S608: NO), the pre-skew correction operation is ended, and the process proceeds to the skew correction operation at S507 of FIG. 5.

If the detected sheet size is within the regular size (S608: YES), the system controller 201 determines the difference between the detected position of the sheet end and the reference position again (S609).

If the difference between the detected position of the sheet end and the reference position is, for example, ±6 mm or greater (S609: NO), the system controller 201 sets "1" for status N used for the pre-skew correction (S610). If the difference between the detected position of the sheet end and the reference position is less than ±6 mm (S609: YES), the system controller 201 sets "0" for the status N used for the pre-skew correction (S611).

Upon setting the status N for the pre-skew correction operation (S612), the system controller 201 starts the pre-skew correction operation actually, in which the system controller 201 conducts a rolling back operation of the sheet. At S612, the system controller 201 controls the rollers in the apparatus to roll back the sheet from the position of the pre-registration sensor 50 to the sheet setting position 41*a* or the sheet setting position 41*b*.

Upon completing the rolling back operation of sheet, the system controller 201 conducts the sheet feed operation (S613). At S613, the system controller 201 controls the rollers in the apparatus to transport the sheet from the sheet setting position 41*a* or the sheet setting position 41*b* to the pre-registration sensor 50.

Upon completing the sheet feed operation, the system controller 201 determines the value of status N set at S610 or S611 (S614). If the status N is "0" (S614: YES), the system controller 201 confirms the completion of the pre-skew correction operation, and conducts the sheet transportation for a given time period (S615), and proceeds to the skew correction operation at S507 of FIG. 5. If the status N is "1" (S614: NO), the system controller 201 reduces the value of the status N from "1", and then repeats the process from S612.

With the above described processing, the pre-skew correction operation of an example embodiment completes. In the above process of FIG. 6, the shutdown operation at S606 is included in the pre-skew correction operation.

Figure 7:
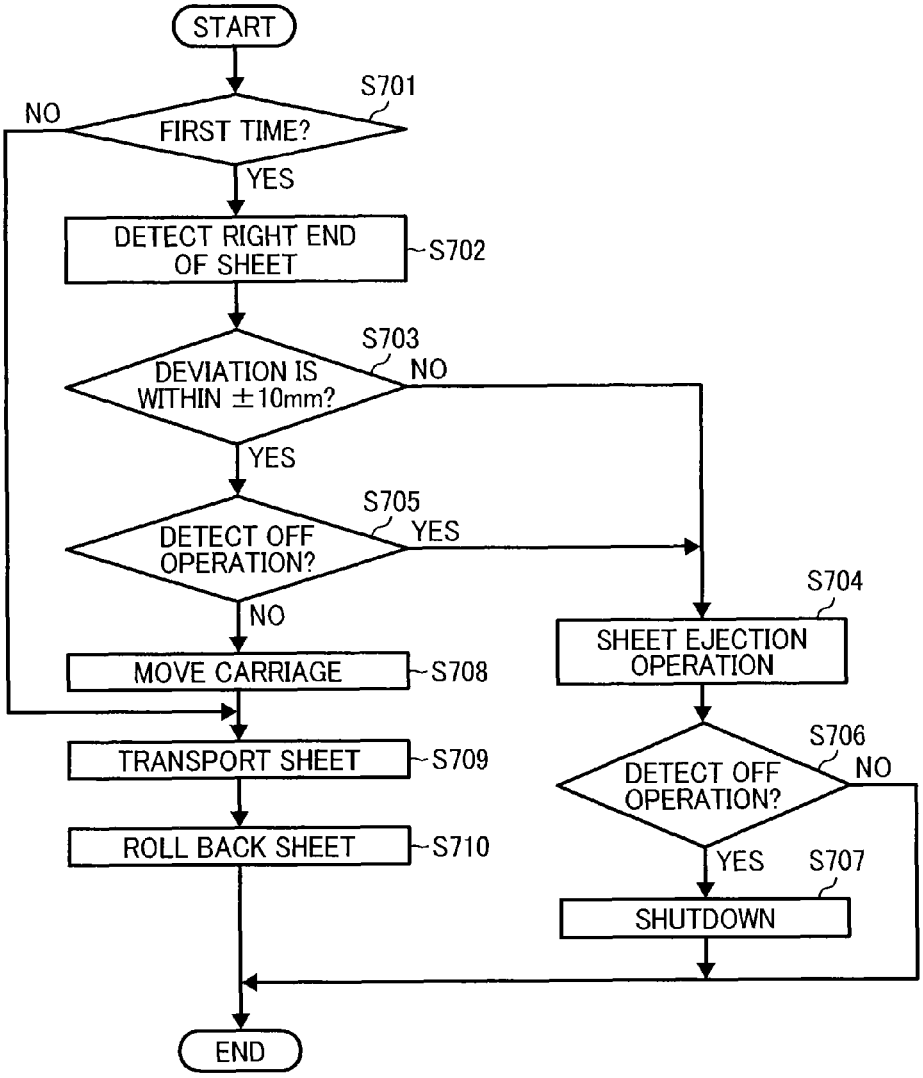
FIG. 7 is a flowchart showing steps of a skew correction operation of the image forming apparatus of FIG. 1.

A description is given of the skew correction operation at S507 of FIG. 5 with reference to FIG. 7. As shown in FIG. 7, upon starting the skew correction operation, the system controller 201 determines whether a current skew correction operation is the first time skew correction operation or the second and subsequent time skew correction operation for one roll setting operation (S701).

If it is determined that the skew correction operation is the first time skew correction operation (S701: YES), the system controller 201 controls the main scanning motor to move the carriage 20 in one direction, and measures one end of the sheet such as sheet right end using the sheet detection sensor disposed for the carriage 20 (S702). The detected sheet right end position is hereinafter referred to as "S1." The system controller 201 stops the carriage 20 at the position where the sheet right end is detected.

Upon detecting the sheet right end, the system controller 201 computes a difference or deviation between the detected position and the reference position. If the difference is greater than, for example, ±10 mm (S703: NO), the system controller 201 conducts the sheet ejection operation (S704). At S704, the transport roller disposed along the transport route of the sheet is rotated in a backward to roll back the sheet, and the pre-skew correction operation and the roll setting operation are aborted.

By contrast, if a difference between the detected position of the sheet right end and the reference position is within ±10 mm (S703: YES), the system controller 201 confirms whether the main switch detector 210 detects the OFF operation of the main switch 120 (S705). If the OFF operation of the main switch 120 is detected (S705: YES), the system controller 201 conducts the sheet ejection operation (S704).

Upon completing the sheet ejection operation, the system controller 201 confirms whether the OFF operation of the main switch 120 is conducted again (S706). If the OFF operation of the main switch 120 is detected (S706: YES), the system controller 201 controls the second switch 208 to turn the apparatus power source at OFF state (S707). By contrast, if the OFF operation of the main switch 120 is not detected (S706: NO), which means when the sheet ejection operation is conducted (S704) because the difference between the detected position and the reference position exceeds ±10 mm (S703: NO), the process ends.

In the shutdown determination process during the skew correction operation, it is determined whether the roll setting operation is continued based on the end position of the sheet. If it is determined that the roll setting operation is not continued, the roll is ejected, and the roll setting operation is aborted in relation with S703 and S704.

In an example embodiment, to prevent the sheet jamming, the apparatus power source is required to be turned OFF state after the apparatus is returned to a condition before the roll setting operation is started. Such control can be conducted using a control of the sheet ejection operation included in the program originally, with which change of program to control the apparatus according to an example embodiment can be reduced.

If the OFF operation of the main switch 120 is not detected at S705 (S705: NO), the system controller 201 continues a normal skew correction operation. In the normal skew correction operation, the system controller 201 moves the carriage 20 to a maintenance discharge position, which is for example at the left side of the main scanning direction (S708). Then, the system controller 201 transports the sheet in the forward direction Xa in the sub-scanning direction (S709). Further, if it is determined that the current skew correction operation is the second and subsequent time skew correction operation at S701 (S701: NO), the process starts from S709.

When transporting the sheet at S709, the transporting distance or amount of the sheet varies depending on the number of times of the skew correction operation. For example, if the skew correction operation is the first time skew correction operation, the system controller 201 transports the sheet for a preset transporting amount L (mm). Further, if the skew correction operation is the second and subsequent time skew correction operation, the system controller 201 transports the sheet for "L−M (mm)," which is obtained by subtracting M from L. The M is a sheet transporting amount used at the skew detection and determination operation (S508 at FIG. 5), which will be described later.

Upon completing the sheet transportation at S709, the system controller 201 drives the rollers in the apparatus to transport the sheet into the backward direction in the sub-scanning direction, with which the sheet is rolled back (S710). At S710, the system controller 201 transports the sheet for −L (mm) without a consideration the number of times of the skew correction operation. Upon completing S710, the system controller 201 instructs the skew detection and determination operation at S508 of FIG. 5.

With the above described processing, the skew correction operation completes. In the above description of FIG. 7, the shutdown operation at S707 is included in the pre-skew correction operation.

Figure 8:
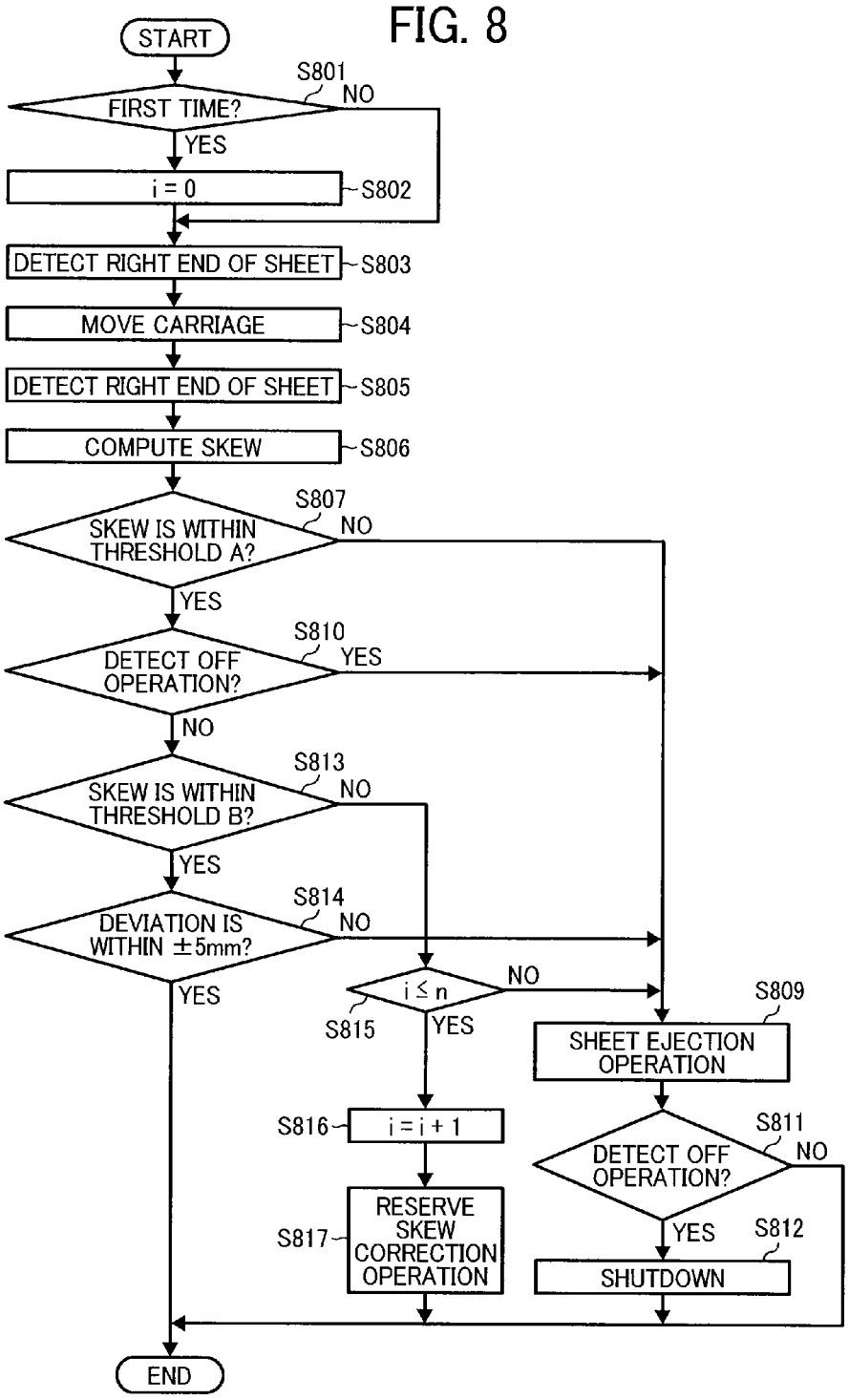
FIG. 8 is a flowchart showing steps of a skew detection and determination operation of FIG. 1.

A description is given of the skew detection and determination operation at S508 of FIG. 5 with reference to FIG. 8. As shown in FIG. 8, upon starting the skew detection and determination operation, the system controller 201 determines whether a current skew correction operation is the first time skew correction operation or the second and subsequent time skew correction operation for one roll setting operation (S801).

Figure 9:
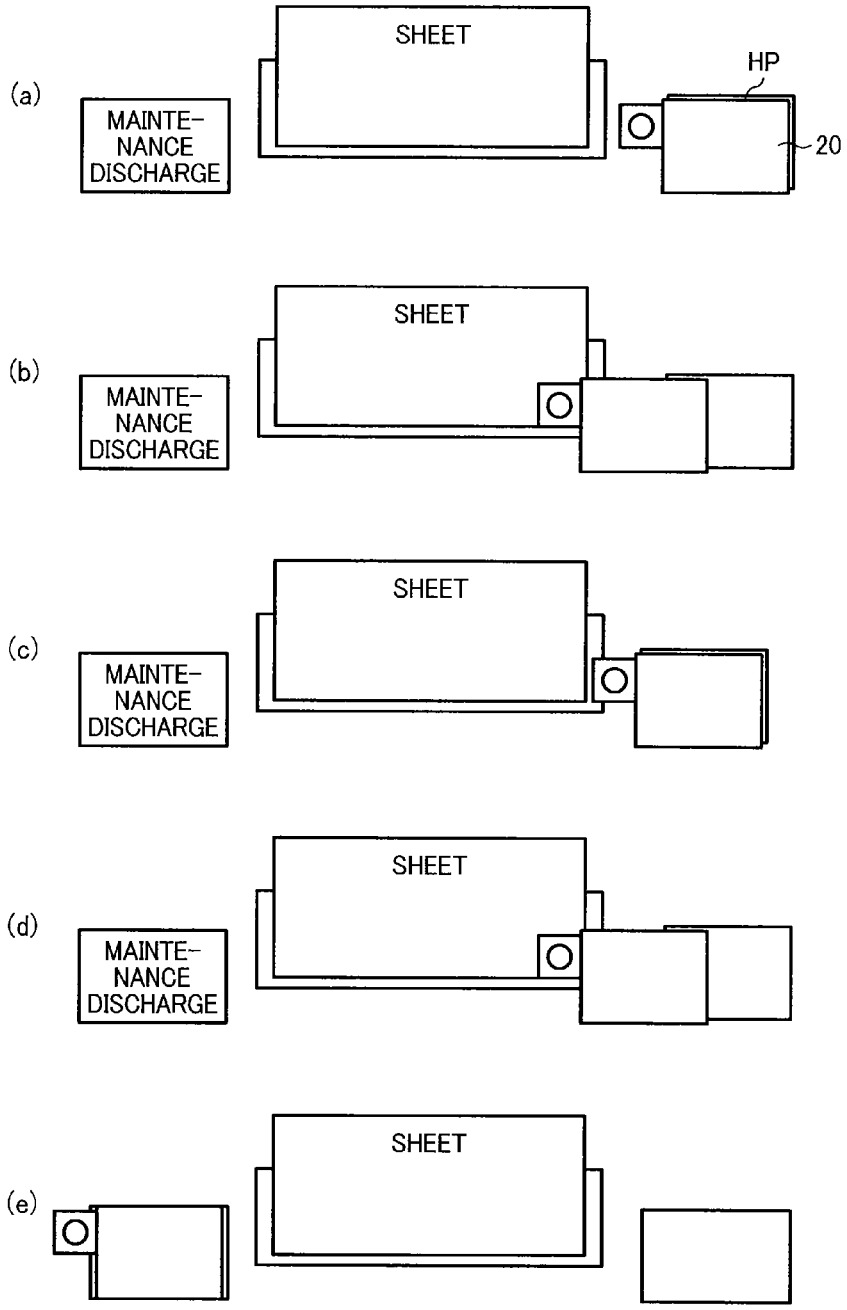
FIGS. 9(*a*), 9(*b*), 9(*c*), 9(*d*) and 9(*e*) show positions of a carriage of the image forming apparatus of FIG. 1.

If it is determined that the skew correction operation is the first time skew correction operation (S801: YES), the system controller 201 sets "0" to a count value "i" used to determine the number of times that the skew correction is repeated (S802). At S801 and S802, the carriage 20 is positioned at the home position HP as shown in FIG. 9(*a*).

After S802, or if it is determined that the skew correction operation is the second and subsequent time skew correction operation at S801 (S801: NO), the system controller 201 drives the main scanning motor to move the carriage 20 in one direction, and measures a position of a right end of the sheet using the sheet detection sensor disposed for the carriage 20 (S803). With this processing, the carriage 20 is moved to a position corresponding to the detected sheet right end shown in FIG. 9(*b*). The sheet right end position at S803 is referred to as S1. Upon detecting the sheet right end, the system controller 201 controls the main scanning motor to stop the movement of the carriage 20, and moves the carriage 20 again to a position corresponding to a position before conducting the skew detection as shown in FIG. 9(*c*) (S804).

Then, the system controller 201 drives the transport roller to transport the sheet in the forward direction in the sub-scanning direction for M (mm) (S805), and moves the carriage 20 again in one direction to measure the right end position of the sheet (S806). With this processing, the carriage 20 is moved to a position shown in FIG. 9(*d*) corresponding to a position after detecting the sheet right end, and the sheet right end position at this timing is referred to as S2. Upon detecting the sheet right end, the system controller 201 controls the main scanning motor to stop the movement of the carriage 20.

With the processes of S803 to S806, a change of the sheet right end position when transporting the sheet for M (mm), which is the sheet skew, can be computed. The system controller 201 computes the sheet skew (%) using the following formula (1) (S807).

$$(|S1-S2|/M)\times 100 \quad (1)$$

Upon computing the skew, the system controller 201 determines whether the skew is within a first threshold A (S807). If the skew is greater than the first threshold A (S807: NO), the system controller 201 conducts the sheet ejection operation (S809). The sheet ejection operation at S809 is the same or similar process of the sheet ejection operation of FIGS. 6 and 7.

If the skew is within the first threshold A (S807: YES), the system controller 201 confirms whether the main switch detector 210 detects the OFF operation of the main switch 120 (S810). If the OFF operation of the main switch 120 is detected (S810: YES), the system controller 201 conducts the above described sheet ejection operation (S809).

Upon completing the sheet ejection operation, the system controller 201 confirms whether the OFF operation of the main switch 120 is detected again (S811). If the OFF operation of the main switch 120 is detected (S811: YES), the system controller 201 controls the second switch 208 to turn the apparatus power source at OFF state (S812). By contrast, if the OFF operation of the main switch 120 is not detected (S811: NO), the process ends.

Similar to FIGS. 6 and 7, in the shutdown determination process during the skew detection and determination operation, the roll is ejected and the roll setting operation is aborted in relation with S807 and S809. To prevent the sheet jamming, the apparatus power source is required to be turned OFF state after the apparatus is returned to a condition before the roll setting operation is started. Such control can be conducted using a control of the sheet ejection operation included in the program originally, with which change of program to control the apparatus according to an example embodiment can be reduced.

If the OFF operation of the main switch 120 is not detected at S810 (S810: NO), the system controller 201 continues a normal skew detection and determination operation. Then, the system controller 201 determines whether the skew is within the second threshold B, which is smaller than the first threshold A (S813). If the skew is within the second threshold B (S813: YES), the system controller 201 determines whether the difference between the sheet right end position S1, detected at S803, and the reference position is within, for example, ±5 mm (S814).

If the difference or deviation between the sheet right end position S1 and the reference position is within ±5 mm (S814: YES), the system controller 201 determines that the skew is corrected preferably, and ends the process. By contrast, if the difference between the sheet right end position S1 and the reference position is greater than ±5 mm (S814: NO), the system controller 201 conducts the sheet ejection operation (S809).

If the skew is greater than the second threshold B (S813: NO), the system controller 201 determines whether the status i, which is the number of repeating times of the skew correction operation is greater than "n" (S815). If the status i is greater than "n" (S815: NO), the system controller 201 conducts the sheet ejection operation (S809). By contrast, if the status i is "n" or less (S815: YES), the system controller 201 increases the status i for one (S816), and instructs a re-conducting of the skew correction operation at S507 of FIG. 5 (S817), and ends the skew detection and determination operation, in which the system controller 201 drives the main scanning motor to move the carriage 20 to a maintenance discharge position shown in FIG. 9(*e*). With this processing, the skew correction operation at S507 of FIG. 5 can be conducted again.

With this processing, the skew detection and determination operation according to an example embodiment completes similar to the operation shown in FIG. 6 and FIG. 7.

A description is given of power OFF timing when the main switch 120 is operated for turning the apparatus power source OFF at one or more timings during the roll setting operation shown in FIG. 5. As to the sequence shown in FIG. 5, the first time shutdown determination can be conducted at the timing of S604 in the pre-skew correction operation shown in FIG. 6 included in the sequence of S506. When the main switch 120 is operated at a timing when a user inserts the sheet and before conducting the pre-skew correction (i.e., from S501 to S505), and a timing of detecting the sheet right end in the pre-skew correction (i.e., between S601 and S602), the first time shutdown determination is used for the shutdown determination.

Because S501 to S505 includes S503, which is an operation of the sheet setting instruction, if the main switch 120 is to be operated actually, the main switch 120 may be operated after S504. The time required for S504, S505 and the subsequently executed S601 to S604 of the pre-skew correction sequence in FIG. 6 may be several seconds to several tens seconds, with which an elapsing time after receiving the power-OFF operation of the user until the power supply becomes OFF state can be limited within a given shorter time.

The next timing for the shutdown determination is at a timing of S705 in the skew correction operation of FIG. 7 included in the sequence of S507. When the main switch 120 is operated after S607 in the pre-skew correction operation of FIG. 6 included in the sequence of the pre-skew correction operation of S506, and at a timing of S701 to S703 in the skew correction operation shown in FIG. 7, the shutdown determination timing of S705 is used. The time required for this determination may be several tens seconds, with which an elapsing time after receiving the operation of the user until the power supply becomes OFF state actually can be limited within a given shorter time.

The next timing for the shutdown determination is at a timing of S810 in the skew detection and determination operation of FIG. 8 included in the sequence of S508. When the main switch 120 is operated after S708 in the skew detection and determination operation of FIG. 7 included in the sequence of the skew detection and determination operation of S508, and at a timing of S801 to S808 in the skew detection and determination operation shown in FIG. 8, the shutdown determination timing of S810 is used. The time required for this determination may be several tens seconds, with which an elapsing time after receiving the operation of the user until the power supply becomes OFF state actually can be limited within a given shorter time.

When the main switch 120 is operated after S813 of FIG. 8 for the skew detection and determination operation (S508), the shutdown is conducted after completing the roll setting operation and ending the shutdown determination restricted period due to the roll setting operation. The time required for this process may be several tens seconds, with which an elapsing time after receiving the power-OFF operation of the user until the power supply becomes OFF state actually can be limited within a given shorter time.

As to the above described image forming apparatus 1000 according to an example embodiment, the shutdown determination process can be conducted at one or more given timings when the roll setting operation is being conducted. Therefore, when the main switch 120 is operated to turn OFF the power supply when the roll setting operation is being conducted, an operator does not need to wait the completion of the entire roll setting operation to set the power OFF state for the image forming apparatus 1000, with which the image forming apparatus 1000 can be turned to power OFF state within a given shorter time period.

The roll setting operation may be started when an operator inserts the front end of sheet in the sheet feed port of the image forming apparatus 1000. Therefore, it is unlikely to receive a power OFF operation during the roll setting operation. For example, at S503, the apparatus receives an instruction from the operator for the above described the roll setting operation. Therefore, it is unlikely to receive a power OFF operation at an earlier timing after S504 actually. However, because it is very difficult to predict how the apparatuses are used by various users, various controls may be required for various situations. The control according the above described example embodiment can reduce the probability of unintended operation of the apparatus due to user operations, which may not be imagined by the designer.

In the above described example embodiment, the inkjet method is used as an image forming mechanism but not limited hereto. The type of the image forming mechanisms are not limited any specific mechanisms as along as the power source control of the roll setting operation of the above described example embodiment is employed. Specifically, the power source control of the roll setting operation of the above described example embodiment can be employed for image forming apparatuses having various image forming mechanisms such as electro-photographic method and thermal method using a roll as an image forming medium or a recording medium with the similar effect.

In the above described image forming apparatus using a roll according to an example embodiment, if a power-OFF operation of the image forming apparatus is instructed when a roll setting operation is being conducted in the image forming apparatus to set the roll ready of an image outputting operation, the time required to turn an apparatus power source to OFF state can be reduced or shortened.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a Wireless Application Protocol (WAP) or 3G-compliant phone) and so on. Since the present invention can be implemented as software, each and every aspect of the present invention thus encompasses computer software implementable on a programmable device.

The computer software can be provided to the programmable device using any storage medium, carrier medium, carrier means, or digital data carrier for storing processor readable code such as a flexible disk, a compact disk read only memory (CD-ROM), a digital versatile disk read only memory (DVD-ROM), DVD recording only/rewritable (DVD-R/RW), electrically erasable and programmable read only memory (EEPROM), erasable programmable read only memory (EPROM), a memory card or stick such as USB memory, a memory chip, a mini disk (MD), a magneto optical disc (MO), magnetic tape, a hard disk in a server, a solid state memory device or the like, but not limited these.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

In the above-described example embodiment, a computer can be used with a computer-readable program, described by object-oriented programming languages such as C++, Java (registered trademark), JavaScript (registered trademark), Perl, Ruby, or legacy programming languages such as machine language, assembler language to control functional units used for the apparatus or system. For example, a particular computer (e.g., personal computer, work station) may control an information processing apparatus or an image processing apparatus such as image forming apparatus using a computer-readable program, which can execute the above-described processes or steps. In the above described embodiments, at least one or more of the units of apparatus can be implemented in hardware or as a combination of hardware/software. In example embodiment, processing units, computing units, or controllers can be configured with using various types of processors, circuits, or the like such as a programmed processor, a circuit, an application specific integrated circuit (ASIC), used singly or in combination.

Numerous additional modifications and variations are possible in light of the above teachings. It is therefore to be understood that, within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus for outputting an image onto a roll sheet used as recording media, the image forming apparatus comprising:

a power shutdown operation detector that detects an operation of shutting down a power supply to the image forming apparatus;

a power supply switching unit that switches a power supply condition of the image forming apparatus; and an apparatus controller that controls the image forming apparatus by controlling the image forming apparatus to perform a roll setting operation of transporting the roll sheet through the image forming apparatus and readying the roll sheet for an image outputting operation, and the power supply switching unit to shut down the power supply to the image forming apparatus based on a detection result by the power shutdown operation detector, wherein the apparatus controller, at least once during the roll setting operation, confirms at least once whether the detection result of the power shutdown operation detector indicates the power shutdown operation has been detected, and wherein the apparatus controller causes the power supply switching unit to switch the power supply condition and shut down power supply to the image forming apparatus based on the roll sheet being ejected from the image forming apparatus and at least one confirmation that the detection result of the power shutdown operation detector indicates the power shutdown operation has been detected.

2. The image forming apparatus of claim 1, wherein the apparatus controller aborts the roll setting operation and ejects the roll outside the image forming apparatus based on the detection result of the power shutdown operation detector, confirms the detection result of the power shutdown operation detector indicates the power shutdown operation has been detected, and controls the power supply switching unit to switch the power supply condition and shut down power supply to the apparatus.

3. The image forming apparatus of claim 1, further comprising at least one sheet detection sensor that detects a position of the roll sheet in the image forming apparatus;

wherein the apparatus controller determines a skew of the roll sheet based on a detection result of the at least one sheet detection sensor, and wherein the apparatus controller determines that a skew correction cannot be conducted based on the detection result by the at least one sheet detection sensor, aborts the roll setting operation, and controls the image forming apparatus to eject the roll sheet.

4. A method of controlling an image forming apparatus for outputting an image onto a roll sheet used as recording media, the method comprising:

starting a roll setting operation that transports the roll sheet in the image forming apparatus and readies the roll sheet for an image outputting operation;

detecting if an operation that shuts down power supply to the apparatus has occurred;

aborting the roll setting operation and ejecting the roll sheet based on a detection result of the detecting;

confirming at least once the detection result of the detecting indicates the operation has occurred; and shutting down power supply to the apparatus based on the ejecting of the roll sheet and the confirming.

5. A non-transitory computer-readable storage medium storing a power source control program that, when executed by a computer having a processor, causes the computer to execute a method of controlling an image forming apparatus for outputting an image onto a roll sheet used as recording media, the method comprising:

starting a roll setting operation that transports the roll sheet in the image forming apparatus and readies the roll sheet for an image outputting operation;

detecting if an operation that shuts down power supply to the apparatus has occurred;

aborting the roll setting operation and ejecting the roll sheet based on a detection result of the detecting of the operation;

confirming at least once the detection result of the detecting of the operation indicates the operation has occurred; and shutting down power supply to the apparatus based on the ejecting of the roll sheet and the confirming.

* * * * *